US006291016B1

(12) United States Patent
Donges et al.

(10) Patent No.: US 6,291,016 B1
(45) Date of Patent: Sep. 18, 2001

(54) METHOD FOR INCREASING CONTACT AREA BETWEEN A VISCOUS LIQUID AND A SUBSTRATE

(75) Inventors: William E. Donges, Wellington; James C. Smith, Amherst, both of OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/324,704

(22) Filed: Jun. 2, 1999

(51) Int. Cl.[7] ..... B05D 3/12

(52) U.S. Cl. ..... 427/348; 427/421; 427/427; 239/419; 239/DIG. 21

(58) Field of Search ..... 427/421, 426, 427/427, 348, 349; 239/99, 419, 549, DIG. 21

(56) References Cited

U.S. PATENT DOCUMENTS 4,031,854 6/1977 Sprague, Jr. ..... 118/641
4,891,249 * 1/1990 McIntyre ..... 427/421
4,957,783 * 9/1990 Gabryszewski ..... 427/424
5,114,752 * 5/1992 Hall ..... 427/273
5,356,050 * 10/1994 Hahn et al. ..... 222/394
5,747,102 5/1998 Smith et al. ..... 427/96

* cited by examiner

*Primary Examiner*—Shrive P. Beck
*Assistant Examiner*—Jennifer Calcagni
(74) *Attorney, Agent, or Firm*—Wood, Herron & Evans, L.L.P.

(57) ABSTRACT

A method of assembling electronic components using a dispenser having a nozzle in fluid communication with a source of viscous liquid having a high surface tension and having an air discharge passage in fluid communication with a source of pressurized air. A droplet of the viscous liquid is dispensed from the nozzle onto a printed circuit board to form an initial contact area between the droplet and the printed circuit board and the high surface tension of the droplet causes the initial contact area to remain substantially constant. A burst of air is then discharged from the air discharge passage for impinging the droplet after the droplet contacts the printed circuit board, which increases the initial contact area between the droplet and the printed circuit board.

10 Claims, 4 Drawing Sheets

METHOD FOR INCREASING CONTACT AREA BETWEEN A VISCOUS LIQUID AND A SUBSTRATE

FIELD OF THE INVENTION

The present invention generally relates to apparatus for dispensing liquid and, more specifically, to apparatus for dispensing droplets of liquid onto a substrate.

BACKGROUND OF THE INVENTION

Electrical components are generally secured to a circuit board or other substrate by means of a soldering operation. Although there are a number of common soldering processes to secure components to the substrate, a conventional soldering process may be comprised of three separate steps. These steps include (1) applying flux to the substrate, (2) preheating the substrate, and (3) soldering various components to the substrate. In some situations, such as reflow and surface mounting processes, preheating is unnecessary. As some examples, the invention pertains to component securement in applications utilizing circuit boards, micropalates, interposer boards, controlled collapse chip collections, VGA and other computer chips.

Soldering flux is a chemical compound which promotes the wetting of a metal surface by molten solder. The flux removes oxides or other surface films from the base metal surface. The flux also protects the surface from reoxidation during soldering and alters the surface tension of the molten solder and the base material. Substrates, such as printed circuit boards, must be cleaned with flux to effectively prepare the board for soldering and to properly wet the electrical components to be secured to the circuit board.

During the soldering operation it may be necessary to dispense minute amounts or droplets of solder flux onto discrete portions of the substrate. Various types of dispensers have been used for this purpose, such as syringe style contact dispensers and valve-operated, noncontact dispensers. In addition to solder flux, other liquids may also be applied to the substrate. These liquids may include adhesives, solder paste, solder mask, grease, oil encapsulants, potting compounds, inks and silicones.

Because of surface tension effects, liquid exiting a valve-operated, noncontact dispenser typically forms a substantially spherically-shaped, airborne droplet before reaching the substrate. The droplet therefore contacts the substrate in a specific, generally circular surface area. Depending upon the viscosity and surface tension characteristics of the droplet material, the droplet may maintain a substantially semi-spherical shape above the surface contact area. For instance, if the droplet material has a high viscosity or high surface tension, the droplet will generally maintain a semi-spherical shape above the surface of the substrate and the surface contact area will be relatively small. For conventional fluxes, the height of the droplet may generally equal the diameter of the droplet. If, however, the droplet material has relatively low viscosity or low surface tension, the spherical shape flattens out onto the surface and the surface contact area is greater. In essence, high viscosity droplets or those with high surface tension do not spread out over the surface like low viscosity droplets or those with low surface tension.

During the manufacture of electronic devices, it is desirable to use the smallest effective amount of flux possible while still covering the greatest amount of surface area with the flux. In many soldering operations, the flux is best applied to a substrate in the form of a series of droplets on discrete areas of the substrate. It is preferable that the single droplet of flux flatten out and form a thin layer over a larger area of the substrate. A relatively thin layer of solder flux has several advantages relative to a thicker layer of flux. For example, a thin layer of solder flux yields more reliable solder connections between the electrical components and, for example, a printed circuit on the substrate, especially where "no clean" fluxes are used. A thin layer formed from a single droplet of flux also uses less flux than several taller droplets of flux used to cover the same area. Also, a single droplet of flux that spreads out to form a thin layer increases manufacturing throughput because applying a single flattened droplet is quicker than covering the same surface area with several taller droplets.

Since solder flux generally has high surface tension, it does not flatten appreciably upon contact with the substrate. Instead, the noncontact dispensing operation leaves a relatively tall droplet with a substantially semi-spherical shape and a small contact area. As a result, it is difficult to produce a thin layer of solder flux using conventional noncontact dispensers and conventional solder flux.

Therefore, it would be desirable to provide a noncontact droplet dispenser which is able to both dispense a droplet of viscous liquid, such as solder flux, and flatten or spread out the droplet onto a substrate to increase its surface contact area.

SUMMARY OF INVENTION

Apparatus of the present invention is adapted to dispense droplets of viscous liquid, such as solder flux, onto the surface of a substrate and thereafter flatten or spread out the droplet with at least one burst of pressurized air. The invention is particularly suitable for noncontact dispensers, that is, dispensers having nozzles that do not contact the substrate during the dispensing operation. In one suitable application of this invention, the substrate is a printed circuit board. The burst of pressurized air impinges on a droplet formed by one or more dispensed droplets with sufficient force to momentarily overcome the surface tension of the droplet, allowing the liquid to spread out over the surface of the substrate to form a larger contact area.

To that end, and in accordance with the principles of the present invention, a dispenser for discharging droplets of liquid onto a substrate and impinging the droplets with air has a dispenser body with a liquid supply passageway adapted to connect to a source of liquid, such as solder flux. A nozzle connects to the dispenser body and includes a liquid discharge passageway in fluid communication with the liquid supply passageway. The nozzle also has an air discharge orifice which is adapted to connect to a source of pressurized air for selectively discharging bursts of the pressurized air. The air discharge orifice is configured proximate to the liquid discharge passageway so that a burst of pressurized air impinges upon a droplet of liquid formed by one or more droplets dispensed from the liquid discharge passageway. The air generally flattens the droplet and increases its contact area with the substrate. The liquid discharge passageway and the air discharge orifice are preferably aligned with one another in a co-axial manner. For example, the liquid discharge passageway may be disposed within and, therefore, surrounded by the air discharge orifice.

In the preferred embodiment, the nozzle comprises a liquid dispensing nozzle body and an air discharge body operatively connected to the dispenser body. The liquid dispensing nozzle body has a liquid passageway which is in fluid communication with the liquid supply passageway of the dispenser body. The liquid dispensing nozzle body is externally threaded such that it can be threaded into internal threads in the dispenser body and internal threads of the air discharge body. The liquid dispensing nozzle body preferably includes a valve seat and the dispenser body preferably includes a valve stem. The valve seat is adapted to selectively receive the valve stem such that when the valve stem engages the valve seat, liquid cannot flow to the liquid discharge passageway. However, upon disengaging the valve stem from the valve seat, liquid can flow through the liquid discharge passageway. A control device is operatively connected to the liquid dispenser to selectively engage and disengage the valve stem relative to the valve seat to dispense the droplets from the liquid discharge passageway.

Preferably, the control device is further operatively connected to the supply of pressurized air to selectively generate bursts of pressurized air for discharge by the air discharge orifice. The control device is operatively connected to pneumatically, hydraulically, or electrically actuated solenoid valves associated with the liquid and pressurized air supplies to accurately control the emitted flow of liquid and bursts of pressurized air from the liquid discharge passageway and air discharge orifice, respectively. The air control device preferably operates in a predetermined time relationship relative to the discharge of the one or more dispensed droplets that will be flattened with the air. For example, the predetermined time relationship may be established between the solenoid valve that operates the discharge of pressurized air and the solenoid valve that controls the discharge of liquid material. It will be appreciated that the liquid and air control device and the components used in such a control device may take many different configurations.

The present invention also contemplates a method for increasing the contact area between a droplet of liquid, such as solder flux, and a substrate, such printed circuit board. The method generally involves dispensing at least one droplet of liquid from a nozzle onto a substrate thereby forming a contact area between the droplet of liquid and the substrate. At least one burst of air is then discharged from an air discharge passage of the nozzle. The burst of air impinges upon the droplet of liquid so as to increase the contact area generally in the manner and for reasons as described above.

Accordingly, the present invention provides a dispenser and method for discharging a droplet of liquid onto a substrate and increasing the surface contact area of the droplet with a burst or bursts of pressurized air. As such, the dispenser can effectively deposit thin layers of flux or other viscous liquid onto a printed circuit board. The thin layer of flux provides a more reliable connection for the electric components and reduces the cost of printed circuit board manufacture. Other suitable applications may also benefit from this invention.

Various additional advantages, objects and features of the invention will become more readily apparent to those of ordinary skill in the art upon consideration of the following detailed description of the presently preferred embodiment taken in conjunction with the accompanying drawings.

DETAILED DESCRIPTION OF DRAWINGS

DETAILED DESCRIPTION OF PREFERRED EMBODIMENT

Figure 1:
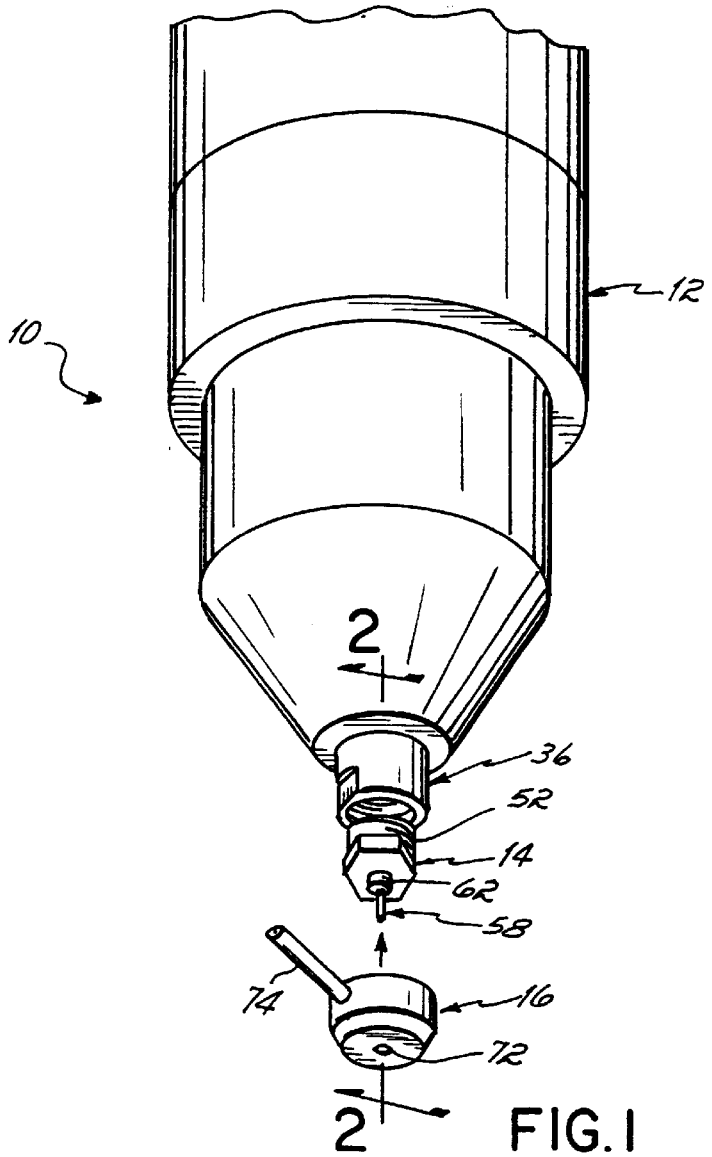
FIG. 1 is a disassembled perspective view of a nozzle assembly attached to the end of a liquid dispenser.

Referring first to FIG. 1, a dispenser apparatus 10 of the preferred embodiment includes a dispenser body 12, a liquid dispensing nozzle body 14, and an air discharge body 16 constructed in accordance with the principles of this invention. While nozzle body 14 and air discharge body 16 are shown as separate pieces, they may also be integrated into a single-piece nozzle. The dispenser 10 is specifically adapted for dispensing liquids, such as heated thermoplastic liquids, hot melt adhesives or solder flux, but other liquid dispensers can benefit from the invention as well. Furthermore, the dispenser 10 is adapted to dispense liquids in discrete amounts, such as droplets or dots, or in continuous beads. As shown in FIG. 1, the dispenser body 12 used in conjunction with the liquid dispensing nozzle body 14 and air discharge body 16 of the present invention is constructed to dispense droplets liquids, such as of solder flux, onto a substrate.

Figure 2:
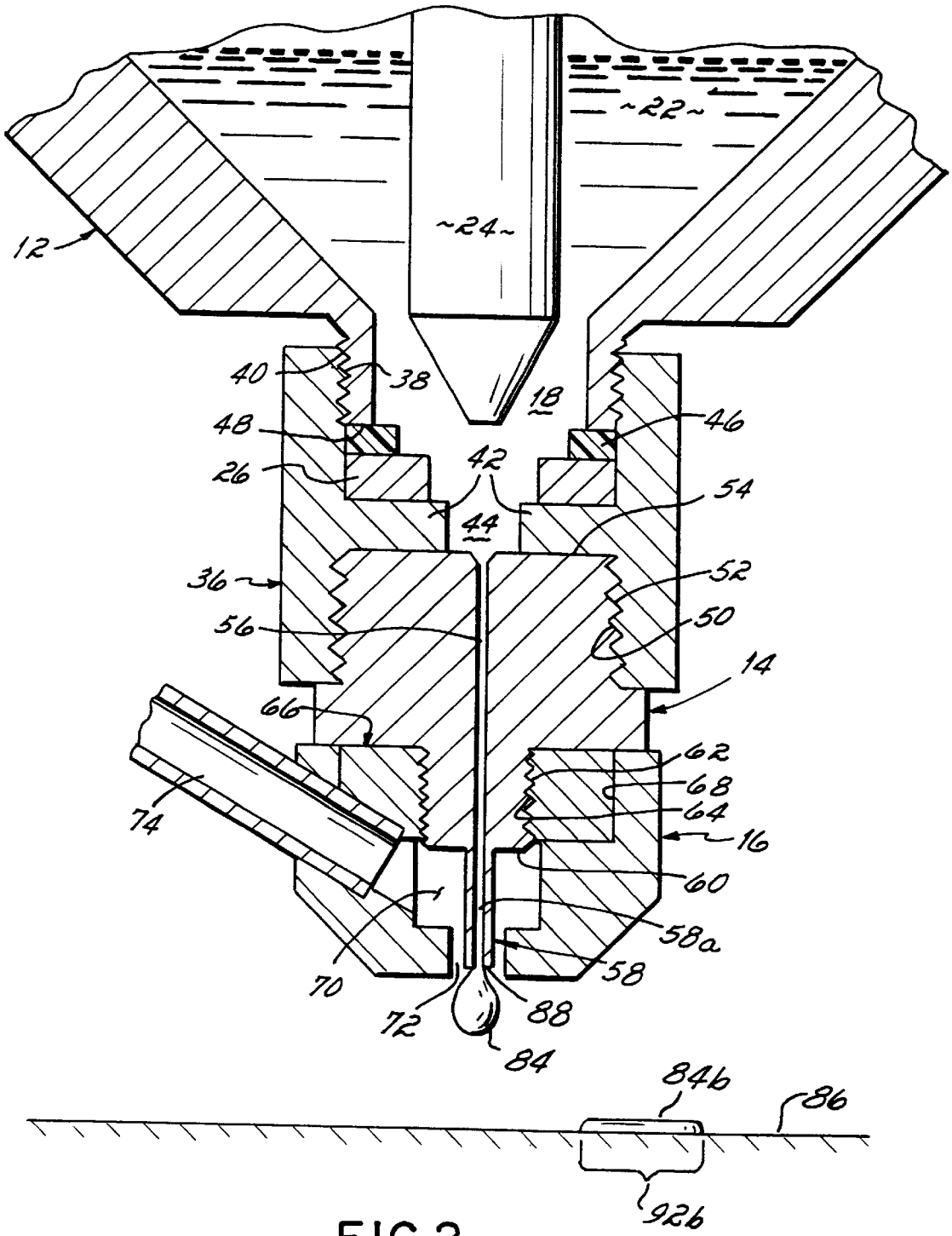
FIG. 2 is an enlarged partial cross-sectional view of the nozzle assembly of FIG. 1 taken along line 2—2 and showing the discharge of a droplet of liquid.
Figure 3:
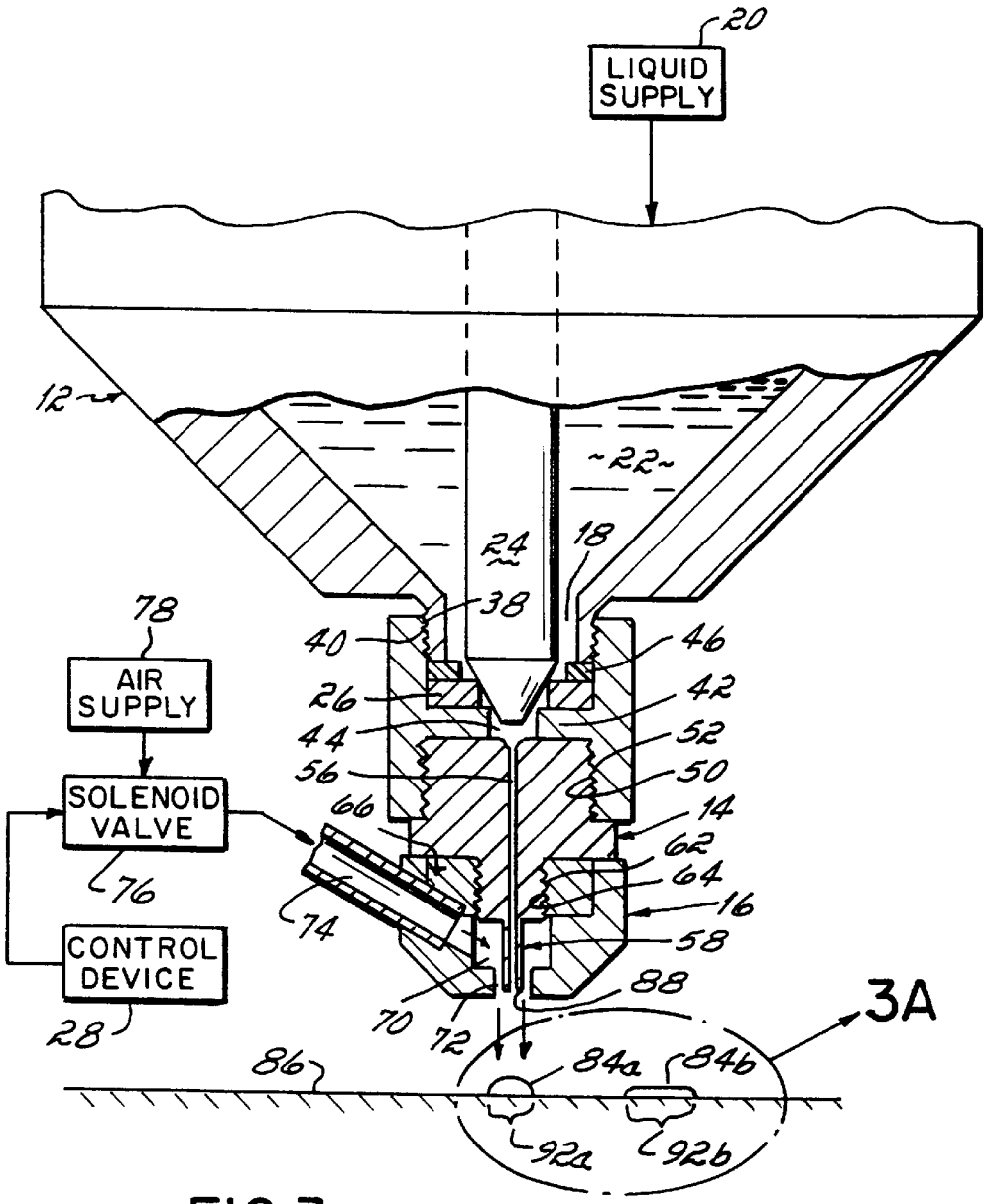
FIG. 3 is an enlarged partial cross-sectional view similar to FIG. 2 but showing the discharge of air.

With reference now to FIGS. 2 and 3, the dispenser body 10 has a liquid supply passageway 18 which communicates with a pressurized source 20 of liquid 22. This liquid 22 may, for example, be solder flux or other viscous liquids that will benefit from this invention. As a general guideline for solder flux applications, the pressure of the solder flux 22 within the liquid supply passageway 18 ranges between about 1.5 psi and about 5 psi for lower viscosity fluxes and 10–20 psi for higher viscosity fluxes. The dispenser body 12 also includes a valve stem 24 mounted within the liquid supply passageway 18 that is selectively retractable from engagement with a valve seat 26. The dispenser body 12 may include a conventional spring return mechanism (not shown) operatively connected to the valve stem 24. The spring return mechanism closes the valve stem 24 against the valve seat 26 to stop the flow of liquid through dispenser 10 in a known manner.

Figure 4:
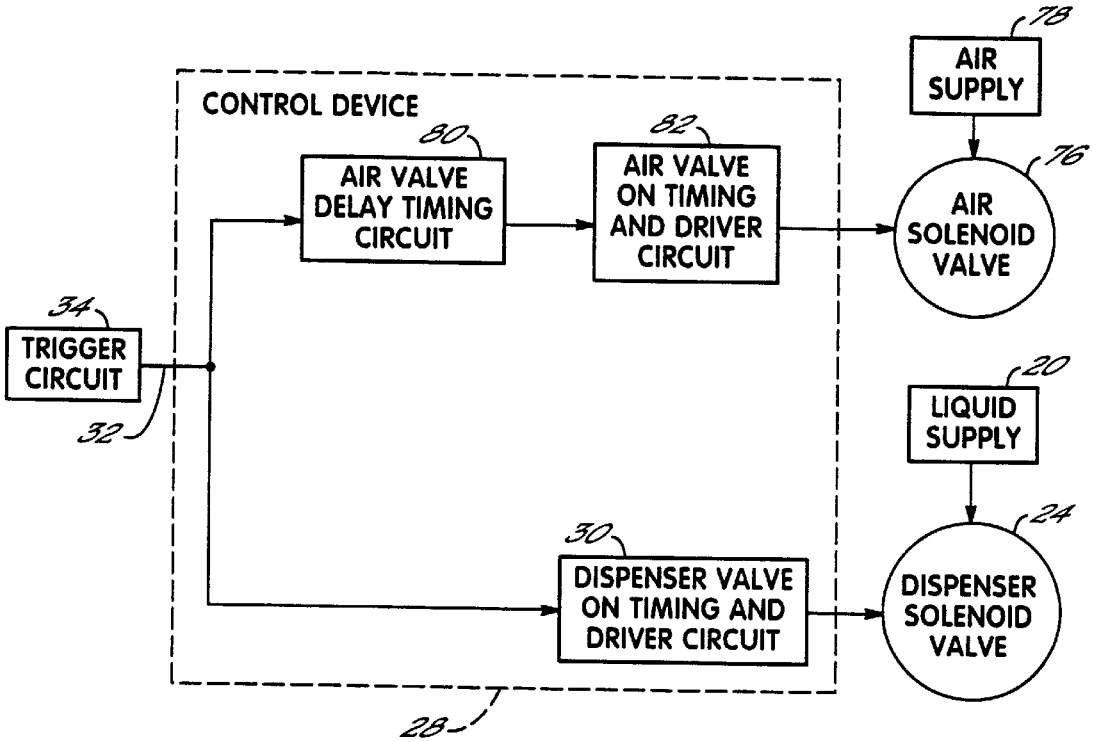
FIG. 4 is a block diagram of a control device for use with the liquid dispenser of FIG. 1.

Accordingly, dispenser body 12 and its associated valve stem 24 can serve as an on/off fluid or liquid valve by moving the valve stem 24 into and out of engagement with the valve seat 26. One suitable dispenser and valve actuating mechanism is found in U.S. Pat. No. 5,747,102, the disclosure of which is fully incorporated by referenced herein. The valve stem 24 may be, for example, pneumatically or electrically actuated in response to a control device 28 (FIG. 4) to selectively dispense the solder flux 22 from the liquid supply passageway 18 to the attached liquid dispensing nozzle body 14.

For controlling dispensing of liquid material, control device 28 includes a dispenser valve on timing and driver circuit 30 that is operatively connected to valve stem 24 to retract valve stem 24 from valve seat 26 in response to a trigger signal 32 received from a trigger circuit 34. Upon receipt of trigger signal 32, circuit 30 retracts or disengages valve stem 24 from valve seat 26 for a pre-selected amount of time, preferably selectable in a range from 0 msec. to about 100 msec., to permit the flow of liquid 22 from dispenser 10 as described in detail below. When the pre-selected open state of valve stem 24 expires, valve stem 24 is re-engaged with valve seat 26 to stop the flow of liquid 22.

A retainer 36 has internal threads 38 at one of its ends to engage external threads 40 of dispenser body 12. The retainer 36 has an internal shoulder 42 with a throughhole 44 located at the center of the internal shoulder 42. The throughhole 44 is in fluid communication with both the liquid supply passageway 18 and the liquid dispensing nozzle body 14. The internal shoulder 42 retains the valve seat 26 and a seal member 46 on an end portion 48 of dispenser body 12 when the retainer 36 is threaded onto the external threads 40 of dispenser body 1 2. As such, the seal member 46, which is preferably constructed of Teflon®, sealingly engages the end portion 48 to prevent the solder flux 22 from leaking past the threads 38, 40. The retainer 36 also has internal threads 50 at its other end. The internal threads 50 are adapted to receive external threads 52 of the liquid dispensing nozzle body 14. Upon threading the liquid dispensing nozzle body 14 onto the internal threads 50, an end 54 of liquid dispensing nozzle body 14 contacts and sealingly engages the internal shoulder 42 of the retainer 36 to prevent the solder flux 22 from leaking past the threads 50, 52.

The liquid dispensing nozzle body 14 has an internal liquid passageway 56 which is in fluid communication with the liquid supply passageway 18 and a liquid discharge passageway 58*a* of a nozzle tip 58 extending from end portion 60 of the liquid dispensing nozzle body 14. The end portion 60 has external threads 62 for engaging internal threads 64 of the air discharge body 16, and more specifically, a plate 66. The plate 66 is press fit into a recess 68 of the air discharge body 16.

The air discharge body 16 has an air chamber 70 and an air discharge orifice 72 which are in fluid communication with an air inlet passageway 74. The air inlet passageway 74 is operatively connected to an air control valve 76 (FIGS. 3 and 4), which may be a solenoid valve operatively connected to a supply of pressurized air 78. For controlling emitted bursts of pressurized air from air discharge orifice 72, control device 28 includes an air delay timing circuit 80 coupled to an air valve on timing and driver circuit 82 that are operatively connected to the air control valve 76. As described in greater detail below, control device 28 and air control valve 76 synchronize the discharge bursts of air from air discharge orifice 72 with the discharge of liquid from liquid discharge passageway 58*a*.

Preferably, air control valve 76 selectively delivers controlled bursts of pressurized air to the air chamber 70 that subsequently exit through air discharge orifice 72. Preferably, air pressure of air supply 78 ranges between about 10 psi and about 30 psi. Higher viscosity materials will generally need higher pressure air. In certain applications, it may be advantageous to impinge a droplet or droplets of liquid with multiple bursts of pressurized air. Also, the pressurized air bursts may be discharged at different pressures to achieve a desired flattening of the liquid droplet. There may also be various applications in which it would be desirable to flatten or spread out certain liquid droplets, but leave other droplets in their typical dispensed condition.

Advantageously, the air chamber 70 and the air discharge orifice 72 are co-axially aligned with the liquid discharge passageway 58*a* extending from end portion 60 of liquid dispensing nozzle body 14. Preferably, the liquid discharge passageway 58*a* is disposed within and surrounded by the air chamber 70 and the air discharge orifice 72.

In operation, the dispenser 10 is adapted to dispense a droplet 84 of flux 22 onto a substrate 86, such as a printed circuit board. Generally, printed circuit board 86 will require several droplets 84 of flux 22 dispensed over specific, discrete areas thereof. During the dispensing operation, the circuit board 86 is held in place and the dispenser 10 is moved relative to the circuit board 86 to each of the desired dispensing locations.

The dispensing method or process contemplated by the present invention begins by positioning the dispenser 10 above a desired dispensing location above the substrate 86. The distance between an end 88 of the liquid discharge passageway 58a and the circuit board 86 can range from about 0.02 inches to about 0.75 inches depending on the application conditions. Next, the valve stem 24 is selectively disengaged from the valve seat 26 in response to receipt of trigger signal 32 by circuit 30 so that the pressurized solder flux 22 can flow through the liquid passageway 56 of liquid dispensing nozzle body 14 for a pre-selected amount of time, as determined by circuit 30. After the pre-selected amount of time of fluid flow has expired, the valve stem 24 re-engages the valve seat 26 to stop further flow of the solder flux 22 into liquid passageway 56. Therefore, and as shown in FIGS. 2 and 3, a droplet 84 of solder flux 22 is formed and then dispensed from the liquid discharge passageway 58*a* of the liquid dispensing nozzle body 14. As shown in FIG. 3, the droplet 84 thereafter falls from the liquid discharge passageway 58*a* to rest upon the substrate 86 as a slightly flattened droplet 84*a* (FIG. 3). The droplet 84*a* forms a contact area 92*a* with the substrate 86.

In response to the trigger signal 32 that initiates dispensing of the droplet 84*a*, air delay timing circuit 80 initiates a pre-selected timing cycle to delay the generation and emission of a burst of pressurized air from air discharge orifice 72 until the pre-selected timing cycle expires. Upon expiration of the timing cycle, air control valve 76 opens for a pre-selected amount of time in response to air valve on timing and driving circuit 82. Preferably, the open state of air control valve 76 is selectable in a range from 0 msec. to about 100 msec.

Figure 3A:
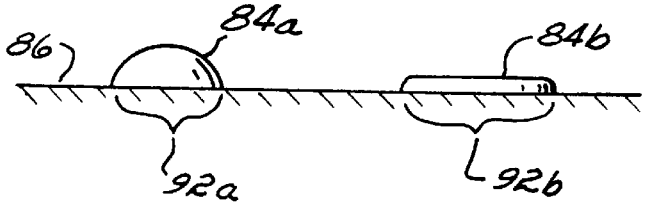
FIG. 3A is an enlarged view of encircled portion "3A" in FIG. 3.

The burst of pressurized air enters air chamber 70 and subsequently discharges through air discharge orifice 72. The pressurized air, as indicated by the vertical arrows in FIG. 3, thereby impinges upon the droplet 84*a* such that the droplet 84*a* is sufficiently flattened to form flattened droplet 84*b*, and the contact area 92*a* is increased to a contact area 92*b* underneath droplet 84*b*, as best shown in FIG. 3A. As such, the height of the flattened droplet 84*b* is greatly reduced from that of droplet 84*a* and the contact area 92*b* is notably greater than contact area 92*a*. That is, the solder flux 22 of droplet 84*b*, once impinged by the burst of pressurized air, spreads out and covers more of the substrate 86 as compared to the initial droplet 84*a*.

After the burst of air impinges upon droplet 84*a*, the dispensing operation for one droplet is complete and the dispenser is repositioned over the next desired dispensing location. This dispensing process continues repeatedly over the printed circuit board until all the desired dispensing locations are covered with flattened droplets of solder flux 22. It should be noted that droplet 84*a* may be comprised of more than one droplet dispensed at the same, or approximately the same, location. In other words, the use of the singular term "droplet" should not be interpreted in a limiting manner in this regard.

Figure 5:
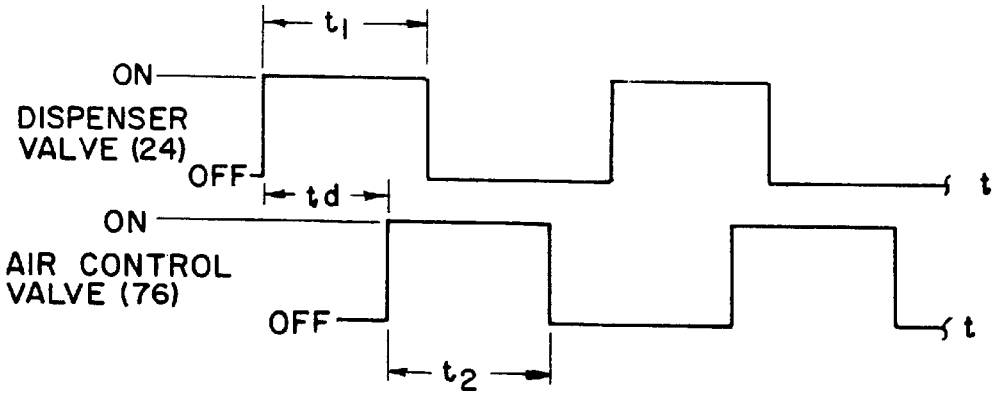
FIG. 5 is a schematic representation of the on/off time profiles for a fluid valve and an air valve implemented by the liquid dispenser of FIG. 1.

As shown schematically in FIG. 5, the valve stem 24, acting as a fluid valve, and the air control valve 76, acting as an air valve, cyclically open and close to respectively dispense discrete amounts of solder flux 22 and bursts of pressurized air. For solder flux dispense applications, the fluid valve 24 preferably remains open a time "$t_1$," ranging between about 2 msec. and about 4 msec. Similarly, the air control valve 76 preferably remains open a time "$t_2$" ranging between about 3 msec. and about 6 msec. for solder flux dispense applications. The air control valve 76 is operable to open a pre-selected duration of time after the fluid valve 24 is opened, as represented by delay time "$t_d$". Therefore, the air control valve 76 can open up prior to the valve stem 24 closing down. If the delay time "$t_d$" is zero, then the air control valve 76 opens at the time the liquid valve 24 opens. In contrast, if the delay time "$t_d$" is equivalent to the time "$t_1$", then the fluid valve 24 closes at the same time that the air control valve 76 opens. Preferably, for solder flux dispense applications, the delay time "$t_d$" ranges between about 2 msec. and about 4 msec. Of course, those of ordinary skill in the art will readily appreciate that the dispense times for liquid material and pressurized air, as well as the pre-selected delay between the respective liquid air dispense cycles, will vary for a particular dispensing application.

As can be appreciated, the amount of solder flux 22 dispensed by the dispenser 10 is dependent on factors such as the pressure of the source 20, the length of time "$t_1$" that the fluid valve 24 remains open, and the physical dimensions of the liquid dispensing nozzle body 14. For instance, increasing the internal diameter of the liquid passageway 56 and the liquid discharge passageway 58*a* at nozzle tip 58 will allow more flux 22 to discharge for a given amount of time "$t_1$". As such, different nozzle adapters 14 with differently sized liquid passageways 56 and liquid discharge passageways 58*a* can be readily threaded into the nozzle adapter retainer 36 to from different sized droplets. As can be further appreciated, the liquid dispensing nozzle body 14 and the air discharge body 16 could be formed as an integral unit.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art.

The invention itself should only be defined by the appended claims, wherein we claim:

1. A method of assembling electronic components using a dispenser having a nozzle in fluid communication with a source of viscous liquid having a high surface tension and further having an air discharge passage in fluid communication with a source of pressurized air, the method comprising:

dispensing a droplet of the viscous liquid from the nozzle onto a printed circuit board to form an initial contact area between the droplet and the printed circuit board, the high surface tension of the droplet causing the initial contact area to remain substantially constant; and discharging a burst of air from the air discharge passage for impinging the droplet after the droplet contacts the printed circuit board to overcome the high surface tension, and thereby increase the initial contact area between the droplet and the printed circuit board.

2. The method of claim 1, wherein the step of discharging the burst of air is initiated before the step of dispensing the droplet is completed.

3. The method of claim 1, further comprising:

discharging multiple bursts of air from the air discharge passage for impinging the droplet and increasing the contact area.

4. The method of claim 3, wherein the multiple bursts of air are discharged at different pressures.

5. A method of assembling electronic components using a dispenser having a nozzle in fluid communication with a source of viscous liquid having a high surface tension and further having an air discharge passage in fluid communication with a source of pressurized air, the method comprising:

dispensing a first droplet of the viscous liquid from the nozzle onto a printed circuit board to form a first contact area between the droplet and the printed circuit board, the high surface tension of the first droplet causing the first contact area to remain substantially constant;

discharging a first burst of air from the air discharge passage for impinging the droplet after the droplet contacts the printed circuit board thereby overcoming the high surface tension and increasing the first contact area between the first droplet and the printed circuit board;

dispensing a second droplet of the viscous liquid from the nozzle onto the printed circuit board to form a second contact area between the second droplet and the printed circuit board, the high surface tension of the second droplet causing the second contact area to remain substantially constant; and discharging a second burst of air from the air discharge passage for impinging the second droplet after the second droplet contacts the printed circuit board thereby overcoming the high surface tension and increasing the second contact area between the second droplet and the printed circuit board.

6. The method of claim 5, wherein the steps of dispensing and discharging are repeated such that subsequent droplets form a layer of the viscous material over a desired area of the printed circuit board.

7. The method of claim 5, wherein the step of discharging the burst of air is initiated before the step of dispensing the droplet is completed.

8. The method of claim 6, wherein each discharging step further comprises:

discharging multiple bursts of air from the air discharge passage for impinging the respective droplets and increasing their respective contact areas.

9. The method of claim 8, wherein the multiple bursts of air are discharged at different pressures.

10. A method of assembling electronic components using a dispenser having a nozzle in fluid communication with a source of solder flux having a high surface tension and further having an air discharge passage in fluid communication with a source of pressurized air, the method comprising:

dispensing a droplet of the solder flux from the nozzle onto a printed circuit board to form an initial contact area between the droplet and the printed circuit board, the high surface tension of the droplet causing the initial contact area to remain substantially constant; and discharging a burst of air from the air discharge passage for impinging the droplet after the droplet contacts the printed circuit board to overcome the high surface tension, and thereby increase the initial contact area between the droplet and the printed circuit board; and repeating the steps of dispensing and discharging to form a thin layer of solder flux over a desired area of the printed circuit board.

* * * * *